US006417496B1

(12) United States Patent
Bates et al.

(10) Patent No.: US 6,417,496 B1
(45) Date of Patent: Jul. 9, 2002

(54) MODULAR HEATING UNIT FOR COOKTOPS

(75) Inventors: Jeffrey A. Bates, Starkville; James E. Small; Christopher R. Taylor, both of Columbus, all of MS (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/757,263

(22) Filed: Jan. 9, 2001

Related U.S. Application Data

(60) Provisional application No. 60/257,405, filed on Dec. 22, 2000.

(51) Int. Cl.[7] ..... H05B 3/68

(52) U.S. Cl. ..... 219/448.11; 219/460.1

(58) Field of Search ..... 219/446.1, 448.11, 219/448.12, 448.14, 448.19, 450.1, 451.1, 452.1, 452.12, 460.1, 461.1, 462.1, 464.1, 465.1, 466.1, 407.1

(56) References Cited

U.S. PATENT DOCUMENTS

| | | | | | |
|---|---|---|---|---|---|
| 3,646,321 | A | | 2/1972 | Siegla | 219/464 |
| 3,710,076 | A | * | 1/1973 | Frazier | 219/448.17 |
| 3,742,179 | A | | 6/1973 | Harnden, Jr. | 219/10.77 |
| 3,796,850 | A | | 3/1974 | Moreland, II et al. | 219/10.49 |
| 3,833,793 | A | * | 9/1974 | McWilliams et al. | 219/461.1 |
| 4,010,412 | A | | 3/1977 | Forman | 323/18 |
| 4,214,151 | A | | 7/1980 | Kicherer et al. | 219/492 |
| 4,237,368 | A | | 12/1980 | Welch | 219/449 |
| 4,414,465 | A | | 11/1983 | Newton et al. | 219/449 |
| 4,499,368 | A | | 2/1985 | Payne | 219/452 |
| 4,553,011 | A | | 11/1985 | Nakata et al. | 219/10.55 B |
| 4,692,597 | A | | 9/1987 | Tsuda et al. | 219/492 |
| 4,788,414 | A | * | 11/1988 | Schreder | 219/451.1 |
| 4,816,647 | A | | 3/1989 | Payne | 219/464 |
| 4,851,645 | A | * | 7/1989 | Wolf et al. | 219/448.17 |
| 4,900,899 | A | * | 2/1990 | Schreder et al. | 219/448.11 |
| 5,128,516 | A | | 7/1992 | Plasko et al. | 219/497 |
| 5,243,172 | A | | 9/1993 | Hazen et al. | 219/450 |
| 5,256,860 | A | | 10/1993 | Newman et al. | 219/464 |
| 5,293,028 | A | | 3/1994 | Payne | 219/486 |
| 5,349,163 | A | | 9/1994 | An | 219/492 |
| 5,397,873 | A | | 3/1995 | Stoops et al. | 219/450 |
| 5,430,427 | A | | 7/1995 | Newman et al. | 338/22 R |
| 5,721,419 | A | | 2/1998 | Wauer et al. | 219/497 |
| 5,809,994 | A | | 9/1998 | Maher, Jr. | 126/374 |
| 5,856,654 | A | | 1/1999 | Frasnetti et al. | 219/481 |
| 5,877,475 | A | | 3/1999 | Hecht et al. | 219/449 |
| 5,893,996 | A | | 4/1999 | Gross et al. | 219/452 |
| 5,981,916 | A | | 11/1999 | Griffiths et al. | 219/492 |
| 6,140,617 | A | | 10/2000 | Berkcan et al. | 219/446.1 |

* cited by examiner

*Primary Examiner*—Sang Paik
(74) *Attorney, Agent, or Firm*—Howrey Simon Arnold & White, LLP

(57) ABSTRACT

The present invention provides a radiant heating unit for a cooktop. The heating unit includes a cooking plate, a support pan, an insulation layer, a heating element, a temperature sensor, and a support post. The support pan is disposed beneath the cooking plate. The insulation layer is supported in the pan and includes an insulation base and an insulation sidewall ring. The heating element is supported on the insulation base in a spaced apart relationship to the cooking plate. The heating element is capable of radiating direct radiant energy. The temperature sensor senses the temperature inside the heating unit and includes a sensing element and lead wires. The support post has an upper head portion and a lower base portion. The upper head portion has a recess to house at least a portion of the sensing element of the temperature sensor. The recess also shields at least a portion of the sensing element from direct radiant energy of the heating element.

27 Claims, 13 Drawing Sheets

MODULAR HEATING UNIT FOR COOKTOPS

The present application claims priority from Provisional Application Serial No. 60/257,405 entitled "Modular Heating Unit For Cooktops And Methods of Operating Same" filed Dec. 22, 2000, which is commonly owned and incorporated herein by reference in its entirety. Moreover, this patent application is related to co-pending, commonly assigned patent application entitled "Controller for a Heating Unit in a Cooktop and Methods of Operating Same" by Edward A. Nelson et al., Ser. No. 09/757,228, filed concurrently herewith and incorporated herein by reference in its entirety.

FIELD OF THE INVENTION

The present invention relates generally to cooktops, and more particularly, to a radiant electric heater unit for cooktops and radiant electric heater units having a temperature sensor that measures differences in reflected radiant energy.

BACKGROUND OF THE INVENTION

Radiant electric heating units, as is well-known in the art, comprise an electrical heating element such as a coil heating element, or a ribbon heating element. In conventional heating units, the ends of the heating element connect through a thermal switch or limiter to an electrical circuit by which current is supplied to the heating element. The unit is installed beneath a cooking surface upon which utensils are placed. When a utensil is placed on the top of the cooking surface, the utensil is heated by direct radiant energy passing through the cooking surface. The utensil is also partially heated by conduction through absorbed radiant energy in the cooking surface. The thermal switch is responsive to the heating unit temperature exceeding a preset temperature to open the circuit path between a power source and the heating element to cut off current flow to the heating element. When the temperature falls back below the preset temperature, the switch reconnects the circuit path to restore the current flow to the heating element.

There are a number of problems with these heating units. One of these is the thermal switch. The thermal switch is expensive, representing 20–30% of the total cost of a heating unit. The switch assembly is a primary source of heating unit failure. It is simply too expensive to replace a failed switch. Rather, when the switch fails, the heating unit is discarded and a new heating unit is substituted in its place. Elimination of the existing thermal switch would not only be a substantial cost savings, but would also improve the service life of a heating unit; provided, that proper temperature control of the heating unit is still maintained. Moreover, these heating units are installed beneath a sheet of glass-ceramic material. This makes removal and installation difficult if the heating unit fails.

There is also a need for boiling liquids faster. Typical heating units drive the temperature to a particular set point without regard to the type of utensil that is on the heating unit or its location. The type of utensil and its location on the heating unit can affect system performance and the time to boil liquids. For example, a concave utensil reflects radiant energy back into the heating unit. A "hot spot" may be formed in the glass-ceramic material underneath the concave portion of the utensil. The pocket of air under the concave portion of the utensil will serve as an insulator, preventing the spot from cooling. Moreover, an off-center utensil can cause portions of the glass-ceramic material not covered by the utensil to reach excessive temperatures. Without knowing the type of utensil or its location on the heating unit, these extreme conditions must be considered when determining the maximum temperature set point in the heating unit. This may result in a lower maximum set point for all types of utensils. A lower maximum set point, however, increases the time to boil liquids in flat pans that are centered correctly. Thus, a further need exists for a heater unit design that allows a controller to determine the type of utensil and whether it was centered properly.

The present invention is directed to overcoming, or at least reducing the effects of, one or more of the problems set forth above.

SUMMARY OF THE INVENTION

To that end, the present invention includes a support for a temperature sensor in a heating unit. The temperature sensor has a sensing element and lead wires. The heating unit has a heating element that radiates direct radiant energy. The support includes an insulating post having an upper head portion and a lower base portion. The upper head portion has a recess to house at least a portion of the sensing element of the temperature sensor. The recess shields at least a portion of the sensing element of the temperature sensor from the direct radiant energy of the heating element. The base portion has at least one hole to receive the lead wires of the temperature sensor.

The head portion of the insulating post may have slots to receive the lead wires of the temperature sensor. The support may further have at least one insulating cover to shield the lead wires from the direct radiant energy of the heating element. The insulating post may be made of ceramic or other insulating materials. In one embodiment, the support is made of ceramic material such as L-3 Steatite. The temperature sensor may be a Platinum Resistance Temperature Detector (platinum RTD).

In another embodiment, the present invention is a temperature sensor assembly for a heating unit. The heating unit has a heating element that radiates direct radiant energy. The temperature sensor assembly includes a temperature sensor and a support post. The temperature sensor has a sensing element and lead wires. The support post has an upper head portion and a lower base portion. The upper head portion has a recess to house at least a portion of the sensing element of the temperature sensor. The recess shields at least a portion of the temperature sensor from the direct radiant energy of the heating element. The base portion has a means for receiving the lead wires of the temperature sensor.

In a further embodiment, the present invention is a heating unit adapted to be installed in a cooktop. The operation of the heating unit is controlled by a controller. The heating unit includes a cooking plate, a support pan, an insulation layer, a heating element, a temperature sensor, and a support post. The support pan is disposed beneath the cooking plate. The insulation layer is supported in the pan and includes an insulation base and an insulation sidewall ring. The heating element is supported on the insulation base in a spaced apart relationship to the cooking plate. The heating element is capable of radiating direct radiant energy. The temperature sensor senses the temperature inside the heating unit and includes a sensing element and lead wires. The support post has an upper head portion and a lower base portion. The upper head portion has a recess to house at least a portion of the sensing element of the temperature sensor. The recess also shields at least a portion of the sensing element from direct radiant energy of the heating element.

The heating unit may be self-contained and modular with respect to the cooktop. The cooking plate is made of as infrared transmissive material such as glass-ceramic. The insulation base has a hole to receive at least a portion of the support post. The hole and the portion of the support post inserted into the hole are shaped to prevent movement of the support post in relation to the insulation base. An insulating paste or cement may further be used to retain the support post in the hole of the insulation base. The temperature sensor may be a platinum RTD.

The above summary of the present invention is not intended to represent each embodiment, or every aspect of the present invention. This is the purpose of the figures and detailed description that follows.

BRIEF DESCRIPTION OF THE DRAWINGS

Other objects and advantages of the invention will become apparent upon reading the following detailed description and upon reference to the drawings.

Figure 1:
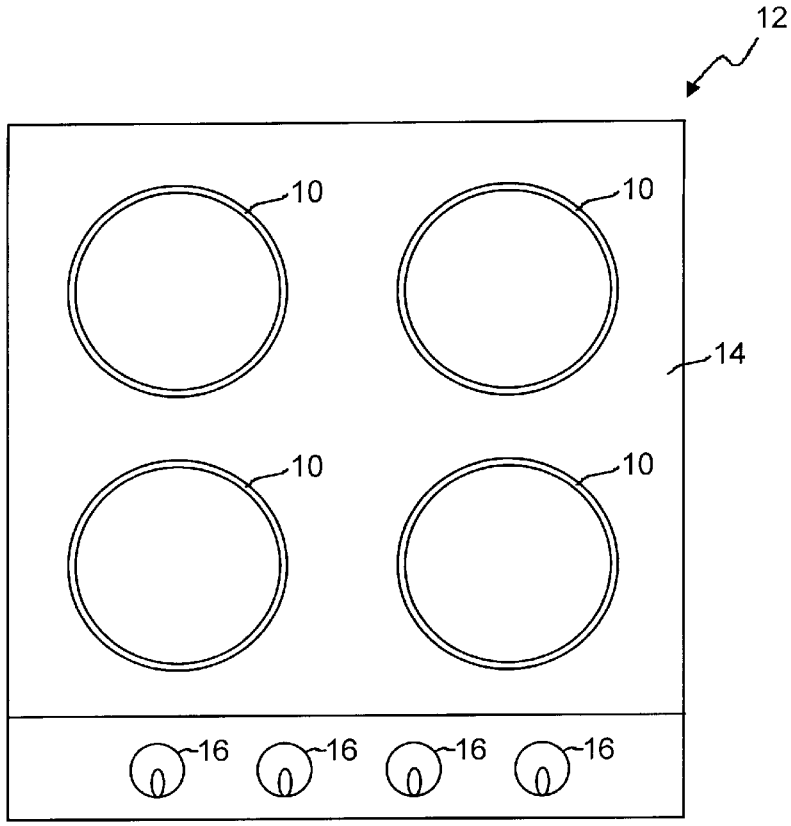
FIG. 1 is a top plan view of a cooktop having modular radiant heating units of the present invention.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

Illustrative embodiments will now be described with reference to the accompanying figures. Turning to the drawings, FIG. 1 shows a plurality (four) of heating units 10 of the present invention installed in a cooktop 12. The heating units 10 may each have the same wattage or the heating units 10 may have different wattages. The cooktop 12 includes a top surface 14 having a plurality of holes to receive and retain the plurality of heating units 10. Someone desiring to cook food or heat liquids places the food or liquid in a utensil (not shown) which is then set upon one of the heating units 10. The user then turns the corresponding control knob 16 or other temperature control device such as a keypad to a setting indicating the temperature to be produced by the heating unit 10 to heat the food or liquid.

Figure 2:
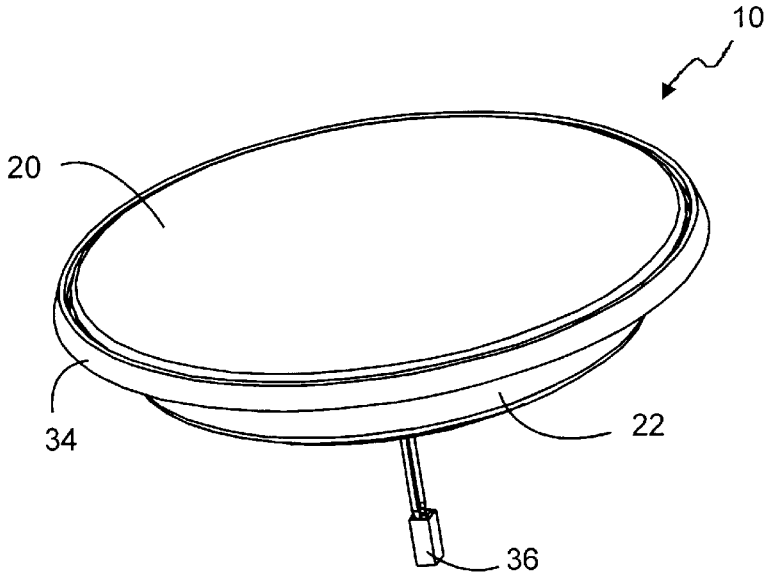
FIG. 2 is a perspective view of one embodiment of a modular radiant heating unit of the present invention.
Figure 3:
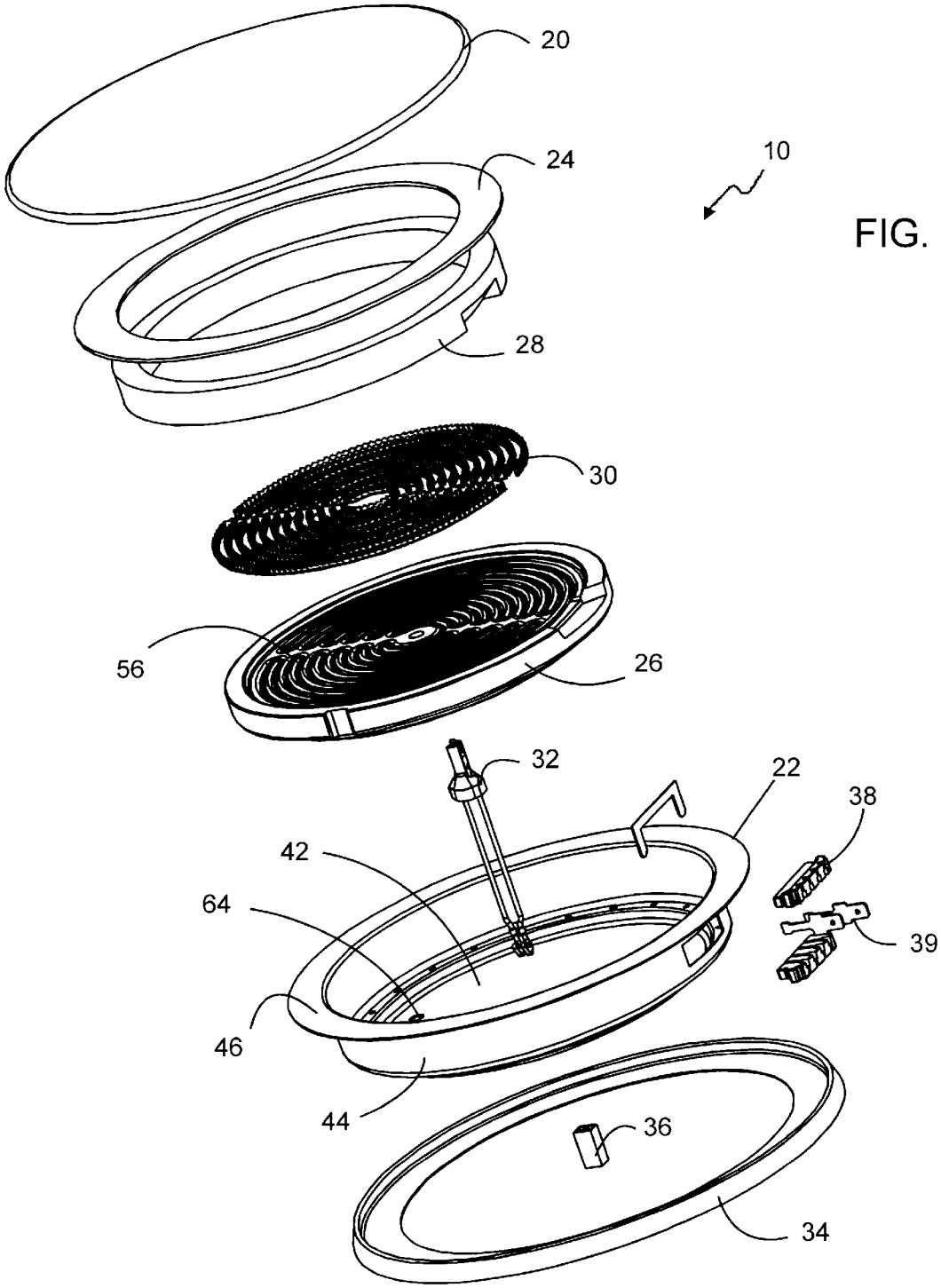
FIG. 3 is an exploded view of the modular radiant heating unit in FIG. 2.

As shown in FIG. 2, in one embodiment, the heating unit 10 of the present invention is self-contained in a single modular unit allowing a user to easily remove and replace the heating unit 10. Referring to FIGS. 2–3, in one embodiment, the heating unit 10 includes a cooking plate 20, a support pan 22, an insulation gasket 24, an insulation layer having an insulation cake base 26 and an insulation sidewall ring 28, a heater element 30, a temperature sensor assembly 32, a decorative ring 34, and terminal blocks 36 and 38. The heating unit 10 is self-contained and modular through its use of terminal blocks 36 and 38. Terminal block 36 serves as a connector that allows for quick connection to and from the signal lines carrying the sensed temperature in the heating unit 10. Terminal block 38 serves as a connector that allows for quick connection to and from the lines carrying the power to activate the heater element 30.

Alternatively, the top surface 14 of the cooktop 12 could be a single cooking surface with no holes. The heating unit 10 may be mounted underneath the top surface to produce heat to the cooking surface. In this alternative embodiment, the heating unit would not have a decorative ring 34. The cooking plate 20 would be replaced by a single cooking surface for all heating units.

The cooking plate or cooking surface 20 is made of an infrared transmissive material such as glass-ceramic. A suitable material is designated as CERAN manufactured by Schott Glass in Mainz, Germany or EuroKera Glass Ceramic manufactured by EuroKera North America, Inc. in Fountain Inn, S.C. Those of ordinary skill in the art will appreciate that as an artifact of the prevalent methods of manufacturing ceramized glass, the cooking surface 20 has a textured or dimpled undersurface. The support pan 22 is disposed beneath the cooking plate 20. The support pan 22 is a shallow pan having a substantially flat base 42, a circumferential sidewall 44 and an outer flange 46. The gasket 24 is disposed between the cooking plate 20 and the outer flange 46 of the support pan 22. The gasket 24 is made from an insulation material such as K-Shield BF Paper from Thermal Ceramics in August, Ga. A suitable assembly for the gasket 24 in a heating unit is taught in Provisional Application No. 60/189,695, entitled "Modular Radiant Heating Unit," which is owned by the assignees of the present invention and incorporated by reference in its entirety.

The insulation layer is supported inside the support pan 22. Specifically, in one embodiment, as shown in FIG. 3, the insulation layer has an insulation cake base 26 and an insulation sidewall ring 28. Although FIG. 3 shows the insulation layer as two separate components, the insulation cake base 26 and the sidewall ring 28 may be a single unitary body. Suitable materials for the insulation layer include Wacker WDS® Thermal Insulation from Wacker Silicones Corp. in Adrian, Mich. and RPC2100 from Thermal Ceramics in Augusta, Ga.

Figure 4A:
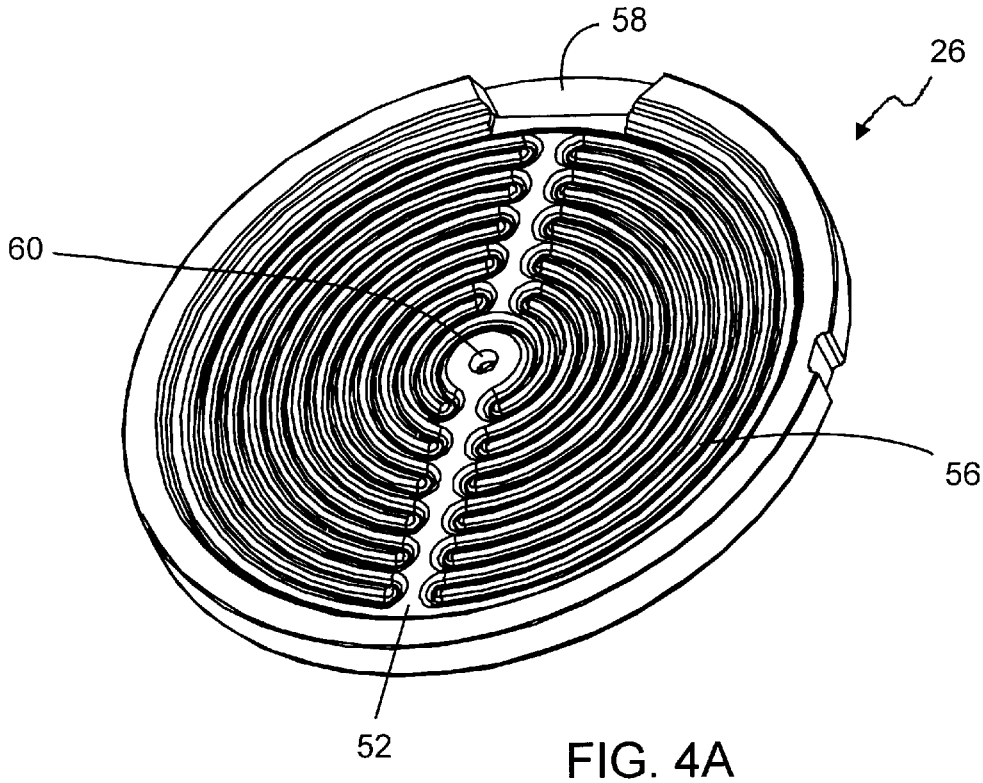
FIGS. 4A–4C are perspective (top and bottom) and plan views of the insulation cake base that may be used in the modular radiant heating unit of the present invention.
Figure 4B:
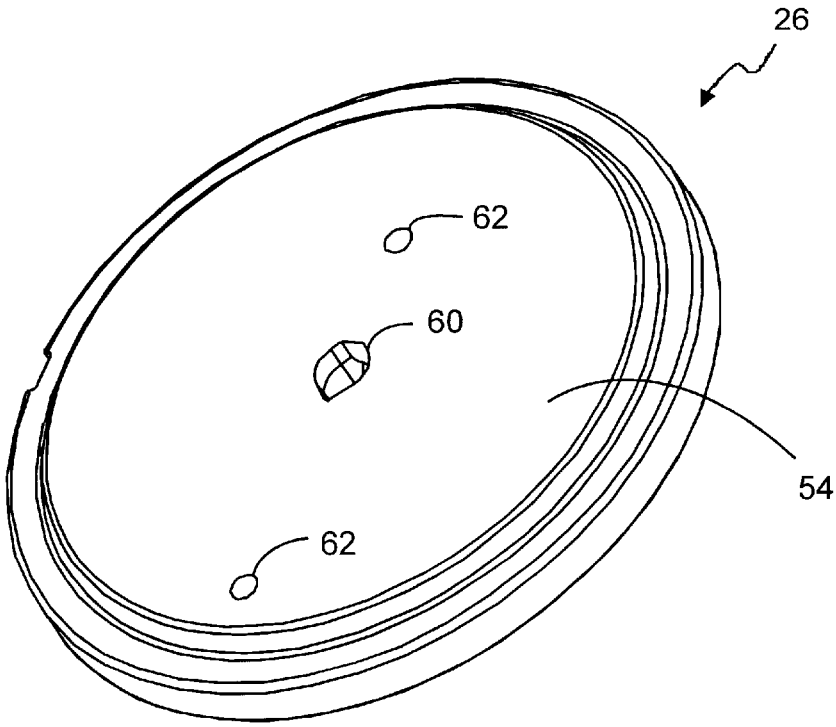
Figure 4C:
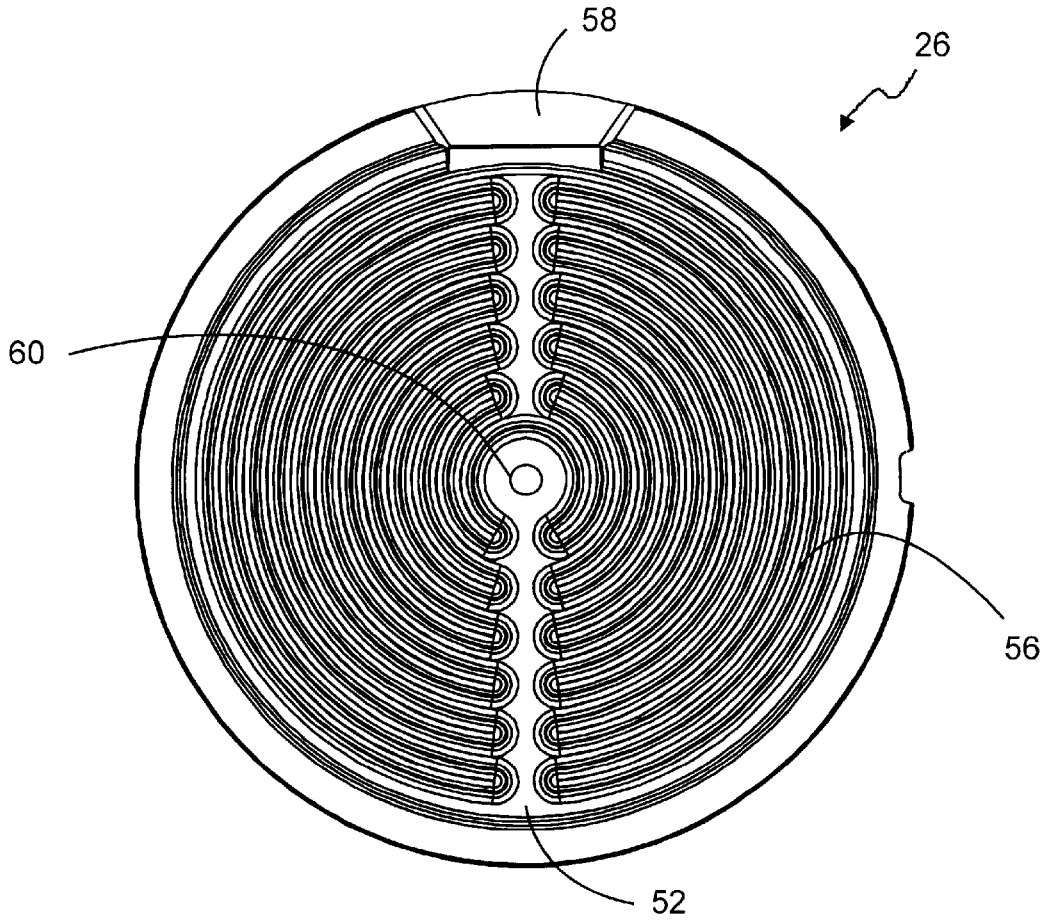

Referring to FIGS. 4A–4C, the insulation cake base 26 has a top surface 52 and a bottom surface 54. The top surface 52 of the insulation cake base 26 has grooves 56 shaped to receive the heating element 30. The top surface 52 of the insulation cake base 26 also has an opening 58 for housing the terminal block 38. In the center of the insulation cake base 26 is a hole 60. The hole 60 is used to receive and retain the temperature sensor assembly 32. In one embodiment, the hole 60 is circular at the top surface 52 of the insulation cake base 26. The hole 60 extends from the top surface 52 of the insulation cake base 26 to the bottom surface 54 of the insulation cake base 26.

Figure 5:
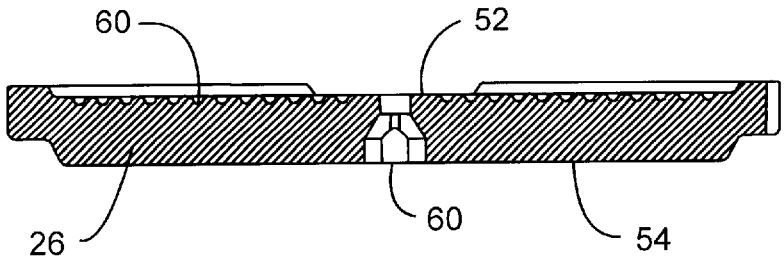
FIG. 5 is a cross-sectional view of the insulation cake base in FIGS. 4A–4C.

FIG. 5 shows one embodiment where the hole 60 is wider in diameter at the bottom surface 54 of the insulation cake base 26 than at the top surface 52. A portion of the temperature sensor assembly 32 is sized to fit within the hole 60. As explained in more detail below, the purpose of varying the diameters of the hole 60 is to provide additional support for retaining the temperature sensor assembly 32 in the insulation cake base 26. Moreover, as illustrated in FIG. 4B, the hole 60 preferably acts as a "key" hole to prevent radial and rotational movement of the temperature sensor assembly 32 in relation to the insulation cake base 26.

The bottom surface 54 of the insulation cake base 26 is shaped to rest in the bottom of the support pan 22. The insulation cake base 26 may have mounting holes 62 to prevent movement of the insulation cake base 26 in relation to the pan 22. The pan 22 has matching holes 64 (see FIG. 3). Screws (not shown) may insert through pan holes 64 and into the cake holes 62 for securing the insulation cake base 26 against the flat base 42 of the support pan 22.

Referring back to FIG. 3, the heating element 30 is supported on the insulation cake base 26 of the insulation layer. In one embodiment, the heating element 30 rests inside grooves 56 of the insulation cake base 26. A plurality of microwire staples (not shown) may be used to secure the heating element 30 to the insulation cake base 26. The presence of the insulation sidewall ring 28, permits the heating element 30 to be in a spaced apart relationship to the cooking plate 20. The heating element 30 is preferably a ribbon type heating element although other types of radiant elements may be used such as coiled or composite heater elements. The heating element 30 radiates infrared energy. The heating element 30 has a serpentine or sinuous pattern when installed on the insulation cake base 26. It will be understood that the pattern shown in FIG. 3 is illustrative only and that the heating element 30 may be laid out in other patterns on the insulation cake base 26 without departing from the scope of the invention. The respective ends of the heating element 30 are connected to a power source (not shown) at a terminal block 38 and male connectors 39.

Figure 6:
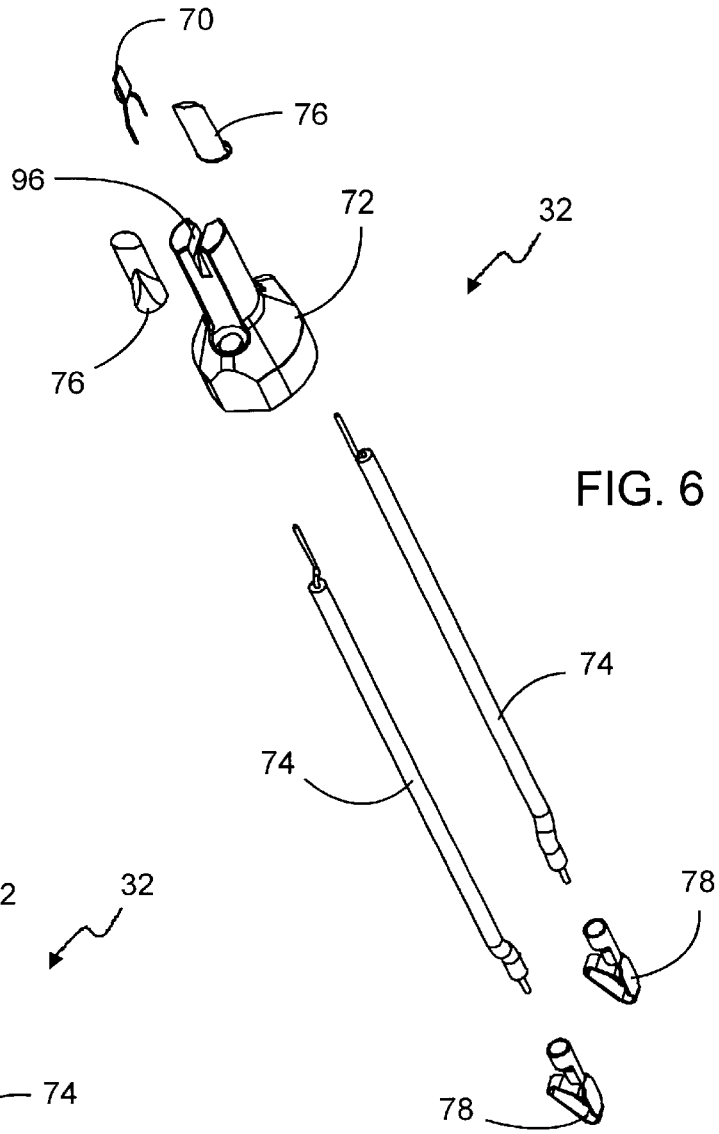
FIG. 6 is an exploded view of one embodiment of a temperature sensor assembly of the present invention.
Figure 7:
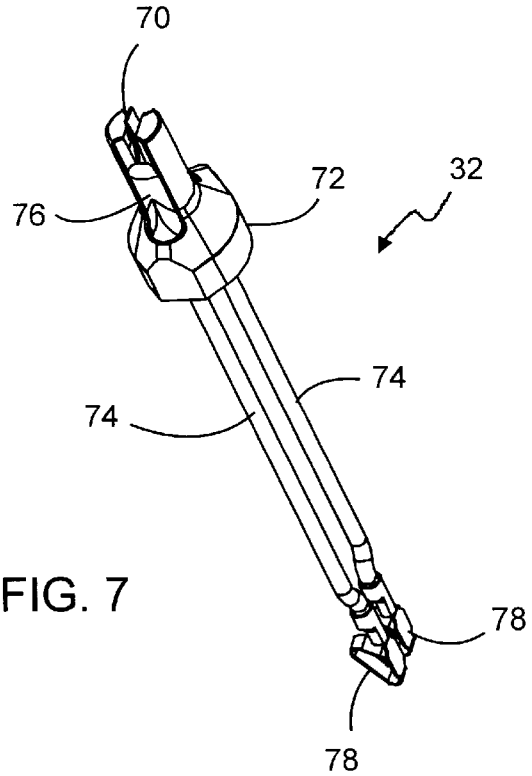
FIG. 7 is a perspective view of an assembled temperature sensor assembly in FIG. 6.

FIGS. 6–7 show exploded and assembled views of the temperature sensor assembly 32. The temperature sensor assembly 32 includes a temperature sensor 70, a support post 72, extended lead wires 74, covers 76 and connectors 78. The temperature sensor 70 mounts inside a recess 96 of the support post 72. The support post 72 is shaped to fit within the center hole 60 of the insulation cake base 26. At one end of the extended lead wires 74, the lead wires 74 are attach to the temperature sensor 70. The extended lead wires 74 pass through the support post 72. At the other end of the extended lead wires 74 are connectors 78. The connectors 78 insert in the terminal block 36 during the assembly of the heating unit 10.

Figure 8A:
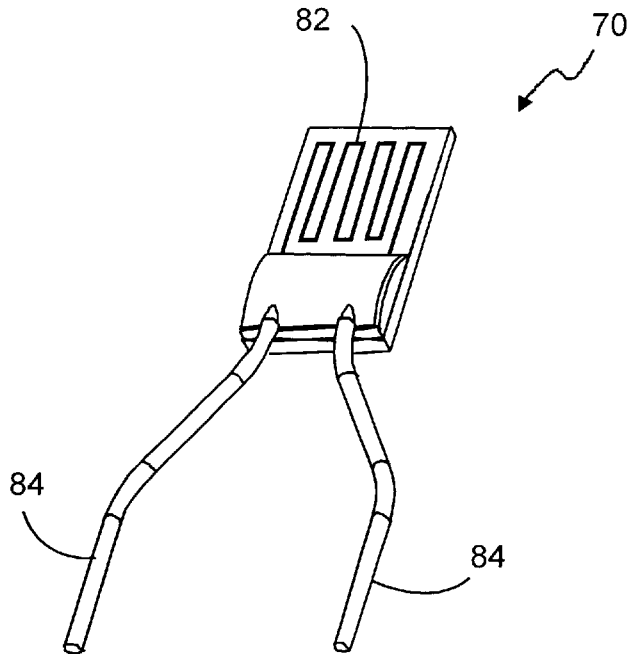
FIGS. 8A–8C are perspective and side views of one temperature sensor that may be used in the modular radiant heating unit of the present invention.
Figure 8B:
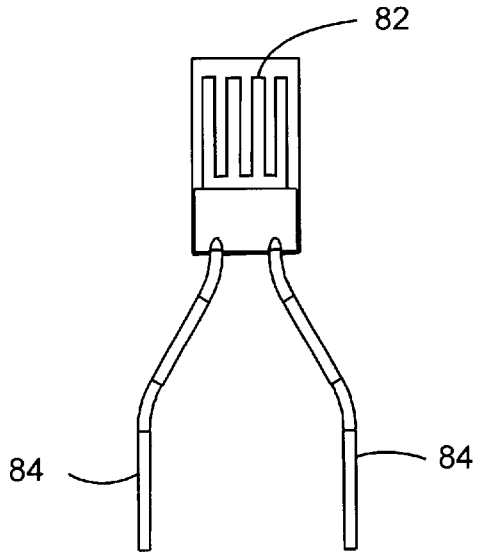
Figure 8C:
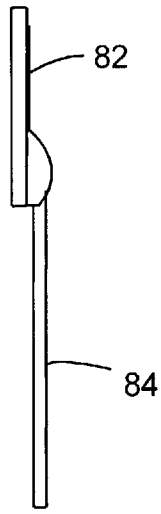

In one embodiment, the temperature sensor 70 is a Platinum Resistance Temperature Detector (platinum RTD). One suitable platinum RTD may be obtained from Heraeus Sensor-Nite Company in Newtown, Pa. The benefit of using a platinum RTD is that it is suitable for high temperatures. A platinum RTD is shown in FIGS. 8A–8C as temperature sensor 70. The temperature sensor 70 has a temperature sensing element 82 and lead wires 84. The lead wires 84 of the temperature sensor 70 are electrically connected to the extended lead wires 74 that pass through the support post 72. It is preferred that the extended lead wires 74 are insulated. Depending on the specific design of the support post 72 and the type of temperature sensor used, the lead wires 84 of the temperature sensor 70 may be exposed and not insulated. This may result in erroneous temperature readings by the temperature sensing element 82. This is due to the fact that heat may conduct through the exposed lead wires 84 and into the temperature sensing element 82. If this is the case, it is preferred that the temperature sensor assembly 32 have some mechanism to insulate the exposed lead wires 84 of the temperature sensor 70. In one embodiment, as shown in FIG. 6, the temperature sensor assembly 32 has insulating covers 76. The covers 76 are made of an insulating material. The covers 76 may also be formed from an insulating paste or cement. A suitable insulating paste or cement is Sauereisen Electric Resistor Cement No. 78 from Sauereisen Company in Pittsburgh, Pa. The Sauereisen cement is supplied as a ready-mixed paste and may be applied by brushing, dipping or spraying.

Figure 9:
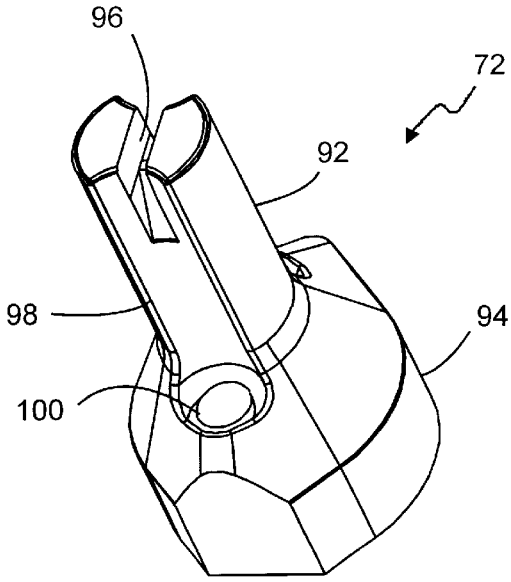
FIG. 9 is a perspective view of one embodiment of a support post for the temperature sensor assembly of the present invention.
Figure 10B:
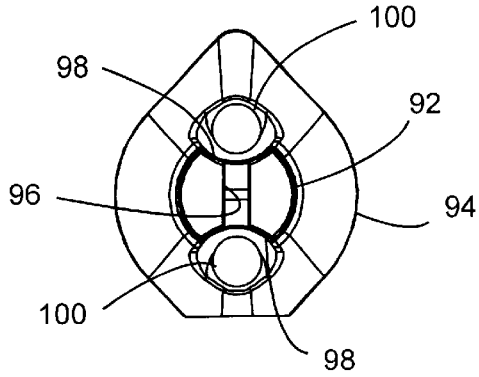
FIGS. 10A–10D are side, top, bottom and cross-sectional views of the support post in FIG. 8.
Figure 10A:
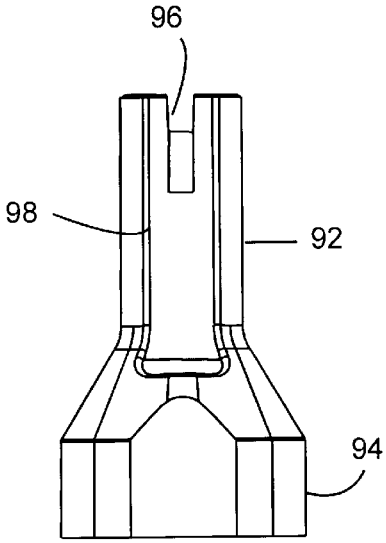
Figure 10C:
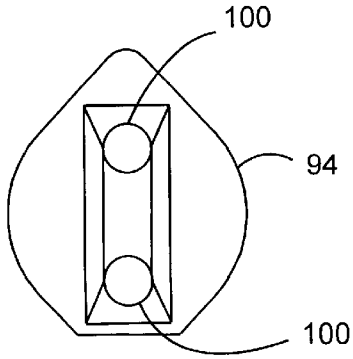
Figure 10D:
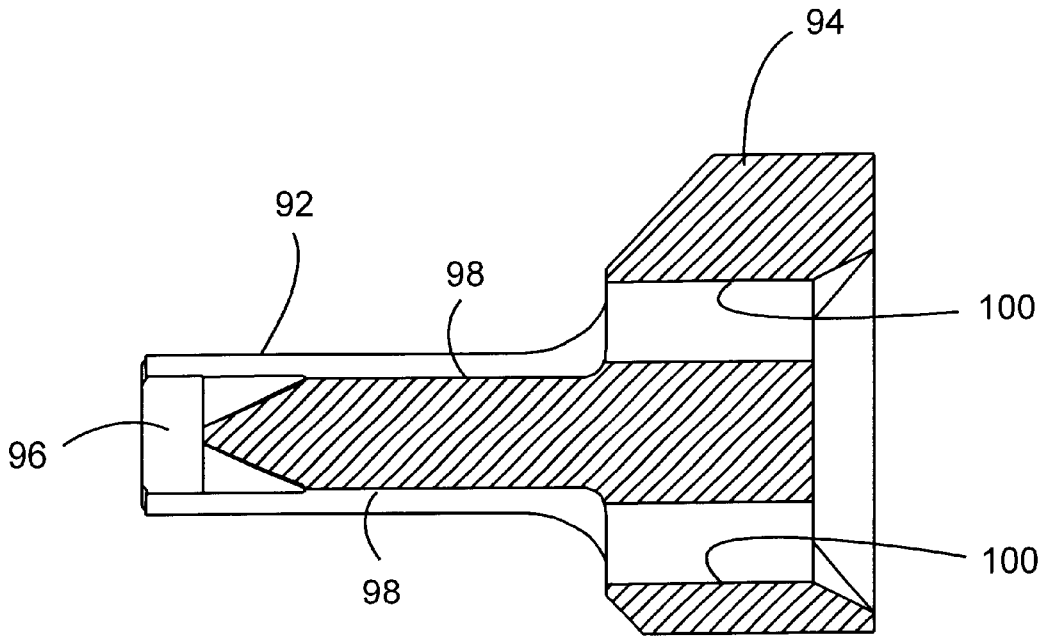

FIG. 9 illustrates a perspective view of one embodiment of the support post 72. FIGS. 10A–10C show side, top and bottom views of the support post 72 in FIG. 9. In this embodiment, the support post 72 has an upper head portion 92 and a lower base portion 94. The support post 72 is preferably made of an insulating material such as ceramic. A suitable ceramic type material is L-3 Steatite. The support post 72 may also be made of other insulating materials such as the material described above for the insulating layer. The upper head portion 92 has a recess 96 to house at least a portion of the sensing element 82 of the temperature sensor 70. The upper head portion 92 further has slots 98 to receive the sensor lead wires 84 and the extended lead wires 74. The base portion 94 is shaped to fit within the center hole 60 of the insulation cake base 26. If the center hole 60 is a "key" hole (as shown in FIG. 4B), the base portion 94 of the support post 72 must be shaped accordingly (as shown in FIGS. 10B–10D). This prevents radial and rotational movement of the temperature sensor assembly 32 with relation to the insulation cake base 26. To further retain the support post 72 in the insulating cake base 26, an insulating paste or cement may be used such as Sauereisen Electric Resistor Cement No. 78.

FIG. 10D illustrates a cross-sectional view of the support post 72. The base portion 94 of the support post 72 may have holes 100. The temperature sensing element 82 rests at least partially in recess 96 of the support post. The sensor lead wires 74 and/or the extended lead wires 84 run down the side of the head portion 92 along slots 98 and through the holes 100 in the base portion 94 of the support post 72. The lead wires 74 and 84 then extend through the base 42 of the pan 22 and are used for transmitting a sensed temperature from the temperature sensing element 82 to a controller.

Figure 11A:
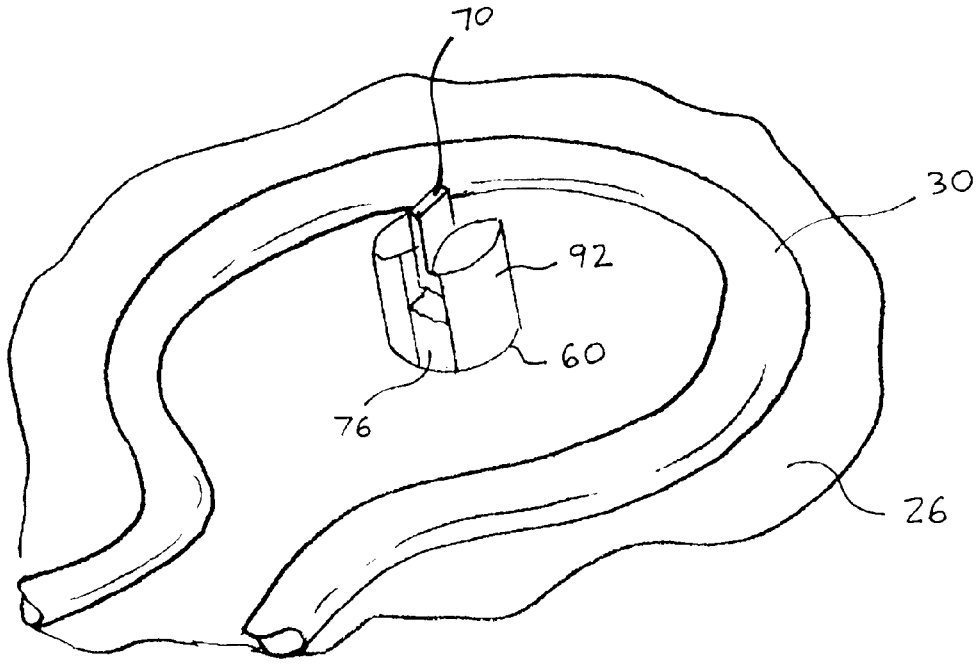
FIG. 11A is an enlarged view of one embodiment of the temperature sensor assembly mounted inside the insulation cake base.

A portion of the head portion 92 of the temperature sensor assembly 32 preferably extends through the center of the insulation cake base 26. FIG. 11A shows an enlarged view of the temperature sensor assembly 32 extending through the center hole 60 in the insulation cake base 26. As described in more detail below, it has been found that positioning the sensor in the center of the insulation cake base 26 provides the benefit of measuring differences in the reflective infrared radiant energy from the heating element 30. This is especially important if the heater element 30 has a pattern as shown in FIG. 3. Moreover, to enhance the measurement of reflective radiant energy, the temperature sensing element 82 should be partially shielded from the direct radiant energy of the heating element 30. It is preferred that the temperature sensing element 82 extend less than 60% from the recess 96 of the support post 72. In one embodiment, the sensing element 82 extends 50% from the recess 96.

Figure 11B:
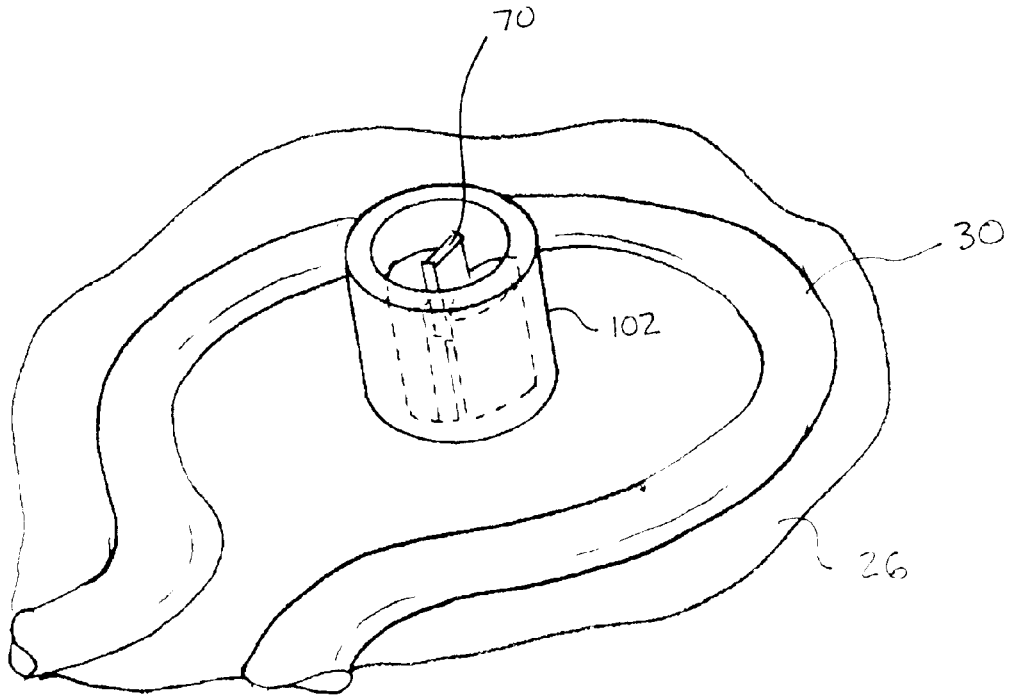
FIG. 11B is an enlarged view of another embodiment of the temperature sensor assembly mounted inside the insulation cake base.

Alternatively, as shown in FIG. 11B, the temperature sensing element 82 may be completely shielded from direct radiant energy from the heating element 30 by the use of a shielding block 102. The shielding block 102 may be a variety of shapes. The embodiment shown in FIG. 11B illustrates a tubular shielding block 102. To eliminate the measurement of direct radiant energy from the heating element 30, the height of the shielding block 102 should be at least as high as the top of the temperature sensing element 72. The shielding block 102 is made of a thermally insulating material such as ceramic. The shielding block 102 may also be formed as part of the insulation cake base 26.

Although FIG. 11B shows a temperature sensing element 82 that is completely shielded from direct radiant energy from the heating element 30, in certain applications where quicker response times are needed, it is better to have the sensing element 82 partially exposed to the direct radiant energy. This is due to the fact that hot air may get trapped in the shielding block 102 and the sensing element 72 may not respond as quickly to temperature changes in the heating unit 10. Accordingly, if a shielding block 102 is used, the mass of the block 102 should be reduced by limiting the width of the wall of the block 102. Alternatively, the height of the block 102 may be reduced.

Figure 12:
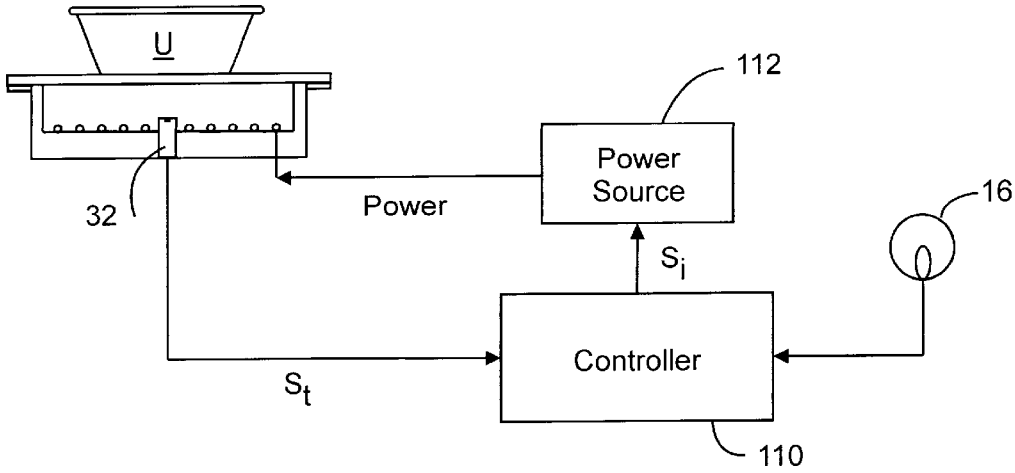
FIG. 12 is a block diagram of the operation of the modular heating unit in connection with a controller for controlling cooking of foods or heating liquids.

It is now desirable to have better control over the cooking of food and heating of liquids than has previously been possible. To this end, referring to FIG. 12, the heating unit 10 of the present invention is usable with a controller 110 that controls the application of power to the heating unit 10 by a power source 112. Operation of the controller may be accomplished by a PID (Proportional, Integral, Derivative) control loop or a PI (Proportional, Integral) control loop. One requirement of heating units is that they now be able to rapidly heat up to an operating temperature. This is evidenced by a heating element 30 of the heating unit 10 reaching a visual response temperature within 3–5 seconds after application of power, by which time the heating element is glowing. Rapid heating of element 30 may be achieved by applying a voltage, for example, 240 VAC across the heating element 30. The voltage being applied the entire time the heating element 30 is on. While this achieves rapid heating, the tradeoff has been increased temperature stress on the heating element 30 and cooking plate 20. This may result in reduced service life of the cooking plate 20. Thus, it is desirable to have a control system that minimizes the temperature stresses on the cooking plate 20.

The controller 110 controls the application of power so that this high level is applied only for a short interval. The temperature sensor 70 has an output temperature signal $S_t$ supplied to the controller 110. Unlike previous heating units employing a temperature responsive switch which acts to cutoff power to a heating element if the temperature of the heating unit becomes too great, the temperature sensor 70 only provides a sensed temperature input to controller 110 via a cable 114. Moreover, the current design utilizes a type of temperature sensor that has less thermal mass. This allows quicker response times and more accurate readings of the temperature in the heating unit 10. The type of sensor shown in FIGS. 8A–8C show a platinum RTD. This type of sensor works better than sensors with larger thermal masses such as probe sensors.

In one embodiment, the control knob 16 has a plurality of settings. For example, the knob 16 may have settings 1–10 where setting 1 refers to minimum heat and setting 10 refers to maximum heat. A user places a utensil U on the heating unit 10 and turns the control knob 16 to a desired setting. For boiling liquids, a user will typically select the highest setting. The controller 110 will receive the desired setting from the knob 16 and assign a first temperature set point. The controller 110 turns on the power to the heating element 30 until the first temperature set point is reached. The controller 110 samples a received temperature signal $S_t$ from the temperature sensor 70 to determine whether the first temperature set point has been reached. After the first temperature set point has been reached, the temperature is maintained by duty cycling the power supplied to the heater element 30.

The controller 110 is responsive to signal $S_t$ so that if the temperature of the heating unit 10 starts to increase above a selected heating value, controller 110 responds by changing the duty cycle or mark-space ratio of a control signal $S_i$ supplied to power source 112. This control signal controls the amount of time within a time interval that current is supplied to heating element 30. Thus, rather than shutting off the heating unit, the amount of heat produced during any given interval is alterable by changing the amount of time current is supplied to heating element 30 during that interval. If current is supplied a lesser amount of time during an interval than previously, the amount of heat produced by heating unit 10 is effectively lowered, as is the temperature to which a utensil placed upon the unit is heated. Besides helping prolong the useful life of heating element 30, this feature further is important in helping prevent the scorching of food.

As noted, controller 110 is responsive to input from the temperature sensor 70 to control application of power to heating element 30. The controller 16 supplies a duty cycle or mark-spaced pulse input control signal $S_i$ to power source 112. The mark-space ratio of the signal is controllable over a wide range of on/off ratios. At any one time, the ratio determines the amount of time within a time interval that source 112 supplies current to heating unit 10. The greater the amount of on-time to off-time within the interval, the longer power is supplied to the heating unit 10 during that interval, and the higher the amount of heat produced by the heating unit 10 during that interval.

In one embodiment, the duty cycle ν is updated after each relay duty cycle and is calculated using the following formula:

$$\nu = K_p * e + (K_p/T_i) * (s(n)) + \nu 0$$

where:

$K_p$=Constant based on set point temperature $K_p/T_i$=Constant based on set point temperature $e = T_{sp} - T_{ave}$ $T_{sp}$=Set point temperature $T_{ave}$=Average temperature over last duty cycle s(n)=s(n−1)+e where s(0)=0 n=number of duty cycles elapsed since duty cycling began

ν0=estimated duty cycle based on set point temperature

Once the set temperature is reached, duty cycling begins at a duty cycle of ν0. As the temperature rises above or below the set point, the duty cycle is corrected by $K_p$*e. Each time a relay's duty cycle ends and the temperature is above or below the set point temperature, that error is added to s(n). As errors continue, the relay's duty cycle will be adjusted by (Kp/Ti)*(s(n)). This will produce a duty cycle when the cavity temperature is at the set temperature of (Kp/Ti)*(s(n))+ν0. The values for Kp and Kp/Ti vary based on the set temperatures. In one embodiment, Kp will range from 0.8 for low temperatures and 2.4 for high temperatures. Kp/Ti may vary from 0.067 for low temperatures and 0.2 for high temperatures. The temperatures are expressed in A/D units.

One of ordinary skill in the art, having the benefit of this disclosure, would realize that other types of control systems and formulas may be used without departing from the present invention.

Figure 13A:
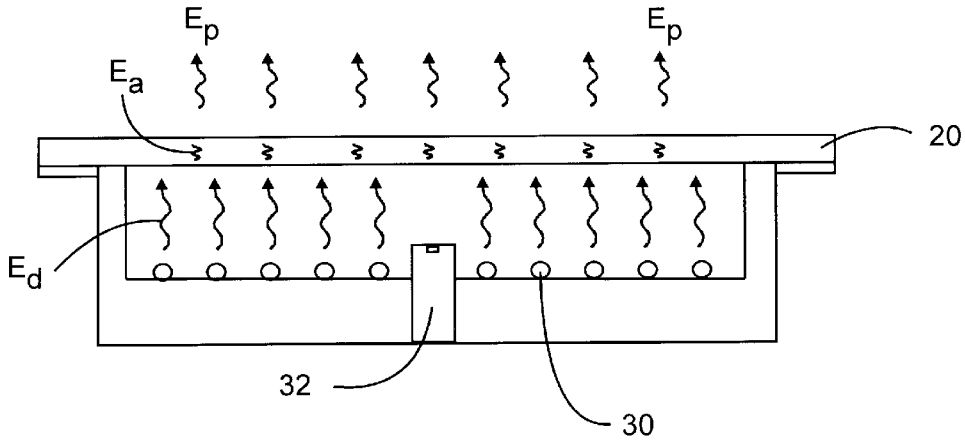
FIGS. 13A–13D are side views illustrating the radiant energy emanating from the heating element.
Figure 13B:
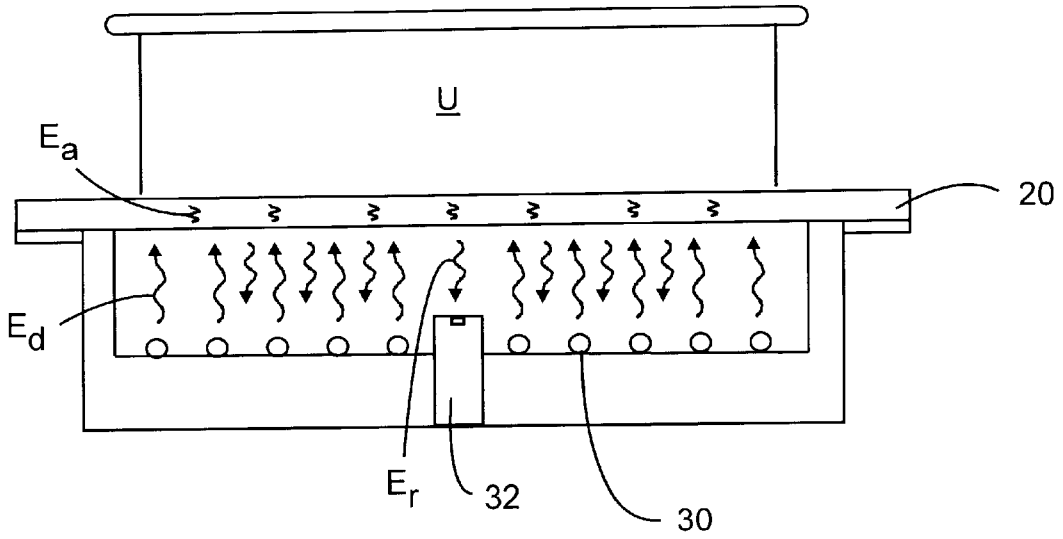
Figure 13C:
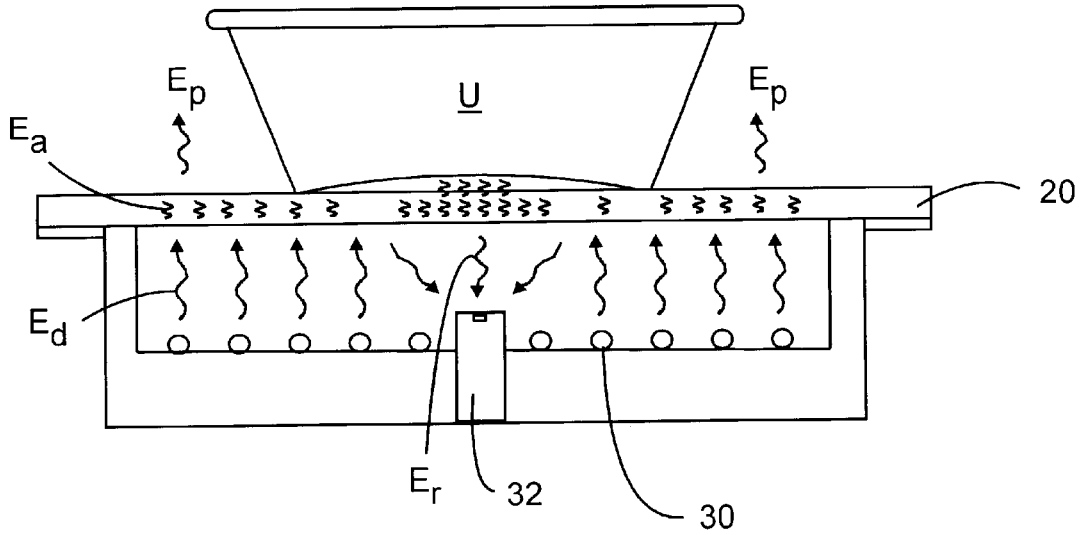

The benefits of the present invention may be demonstrated with reference to FIGS. 13A–13C. As illustrated in FIG. 13A, the heating element 30 radiates direct infrared energy $E_d$ in the electromagnetic radiation spectrum. As indicated above, the cooking plate 20 is made of an infrared transmissive material such as glass/ceramic. When the heating element 30 is activated, a portion of the radiant energy passes through the cooking plate 20 as passed radiant energy $E_p$. A portion of the radiant energy is also absorbed by the cooking plate 20 as absorbed energy $E_a$. When a utensil is placed on the top of the cooking plate 20, the utensil is heated by the direct radiant energy $E_p$ passing through the cooking plate 20. The utensil is also partially heated by conduction through the absorbed radiant energy $E_a$ in the cooking plate 20.

As illustrated in FIG. 13B, when a utensil U is present, some of the radiant energy passing through the cooking plate 20 is reflected back into the heating unit 10 as reflected radiant energy $E_r$. It has been found that shielding a substantial portion of the temperature sensing element 72 from the direct radiant energy $E_d$ of the heating element 30 provides several benefits. For example, when partially shielded, the temperature sensing element 72 is capable of measuring differences in the reflected radiant energy $E_r$. The reason that the sensing element 72 should be partially shielded from direct radiant energy $E_d$ of the heating element 30 is because the amount of reflected radiant energy $E_r$ in the cavity of the heating unit 10 is going to be much less than the direct radiant energy $E_d$. This is due to the fact that a portion of the direct radiant energy $E_d$ is absorbed by the cooking plate 20, a portion of the direct radiant energy $E_d$ is lost to the ambient environment, and a portion of the direct radiant energy $E_d$ is absorbed by the utensil placed on top of the cooking plate 20—leaving a relatively smaller portion of reflected radiant energy $E_r$. If the temperature sensing element 72 is partially shielded from the direct radiant energy $E_d$ from the heating element 30, the temperature sensing element is then capable of measuring differences in the smaller amount of reflected radiant energy $E_r$ in the cavity.

It has been discovered that monitoring differences in the amount of reflected radiant energy $E_r$ in the cavity enables detection of the type of utensil placed on the cooking plate 20. The monitoring can also detect if a very small utensil or off-center utensil is present. Once the type of utensil on the cooking plate 20 is determined, it is possible to decide whether to increase or decrease the set point. Increasing the set point will boil liquids quicker.

For example, FIG. 13B illustrates a dark flat utensil U that covers a substantial portion of the cooking plate 20. In this situation, a portion of the direct radiant energy $E_d$ is absorbed by the cooking plate 20 and a portion of the direct radiant energy $E_d$ is absorbed by the utensil U. Only a small amount of radiant energy is reflected for a dark flat utensil U. For a dark flat utensil, it is safer to operate the heating unit 10 at a higher set point than it would be for shiny concave utensils or off-center utensils.

As illustrated in FIG. 13C, shiny concave utensils reflect radiant energy $E_r$ toward the center of the concave utensil. This directs excessive energy to a specific location on the cooking plate 20. Moreover, an air pocket is formed between the concave portion of the utensil and the cooking plate 20. This air pocket serves as an insulator, preventing the absorbed radiant energy $E_a$ in the cooking plate 20 from dissipating. Over time, the cooking plate 20 may fail or, if a conventional control system is used, the heater element will cycle on and off. A lower set point must be used for concave utensils.

Figure 13D:
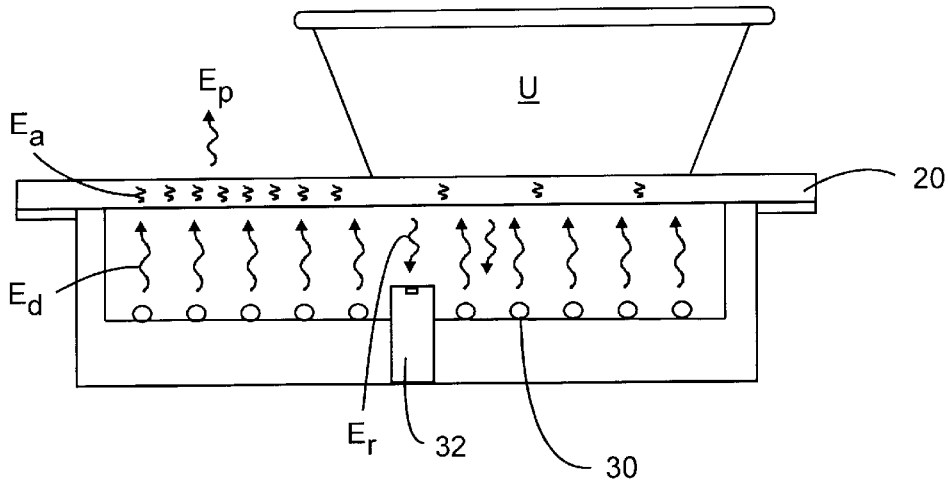

An off-center utensil is illustrated in FIG. 13D. The portions of the cooking plate 20 that are not covered by the utensil U absorb energy $E_a$. This absorbed energy $E_a$ will not dissipate to the ambient environment as quickly as it is being absorbed. Thus, the cooking plate 20 may reach excessive temperatures at uncovered regions of the cooking plate 20. Accordingly, a lower set point must be used for off-center utensils.

Hence, the present invention includes methods of operating a heating unit 10 and determining whether the heating unit 10 may go into an overdrive state. In particular, the methods allow for the controller 110 to determine if a utensil is concave or if the utensil is off-centered. If a concave or off-centered utensil is present, the controller 110 can direct the heater element 30 to maintain the current set point or lower the set point. On the other hand, if a flat utensil (as shown in FIG. 13B) is present, the controller can direct the heater element 30 to an overdrive state where the heater element is controlled at a higher set point. This results in a shorter time to boil liquids.

Figure 14:
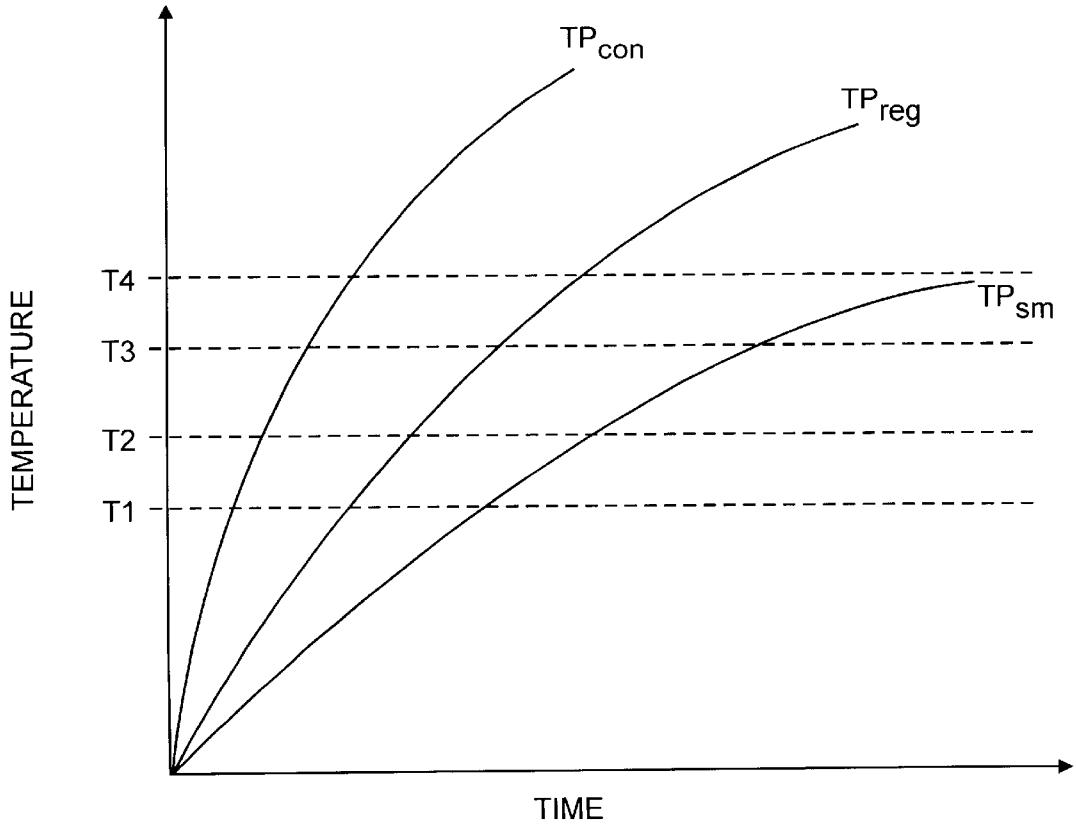
FIG. 14 is a temperature profile of different types of utensils on the heating unit.

One way of determining whether to go into an overdrive state is shown in FIG. 14. FIG. 14 illustrates three different temperature profiles for different types of utensils and their location. With the sensor embodiment described earlier, it has been observed through trials that a concave utensil has a faster rate of temperature rise over time as illustrated in temperature profile $TP_{con}$. A flat utensil that is properly located on the heating unit will have a slower rate of temperature rise as illustrated in temperature profile $TP_{reg}$. If the utensil is very small or off-centered, the rate of temperature rise is even smaller as illustrated in $TP_{sm}$.

Thus, the determination of whether to go into an overdrive state may be based on whether certain conditions exist in the temperature profile. At startup, when the knob 16 is set at its highest setting, the controller 110 will direct the heating unit 10 to a first set point. In one embodiment, the first set point may be 1140° F. for a heating unit 10 capable of outputting 2600W. The controller 110 measures the temperature profile of the heating unit 10 as it attempts to reach the first set point.

The temperature profile may be determined by measuring: (1) a first period of time that it takes the sensed temperature $S_t$ to travel from a first temperature $T_1$ to a second temperature $T_2$; and (2) a second period of time that it takes the sensed temperature $S_t$ to travel from a third temperature $T_3$ to a fourth temperature $T_4$. In this embodiment, the first period of time is compared to the second period of time. In one trial, where the heating unit 10 was outputting 2100W or less, the first and second periods of time were calculated using $T_1$=830° F., $T_2$=1015° F., $T_3$=1085° F., and $T_4$=1230° F. These trials determined that the utensil was concave if the second period of time was at least 1.29 times the first period of time. For a very small utensil or a utensil that was off-center, the first period of time would typically exceed 120 seconds and the second period of time would typically exceed 240 seconds.

Figure 15:
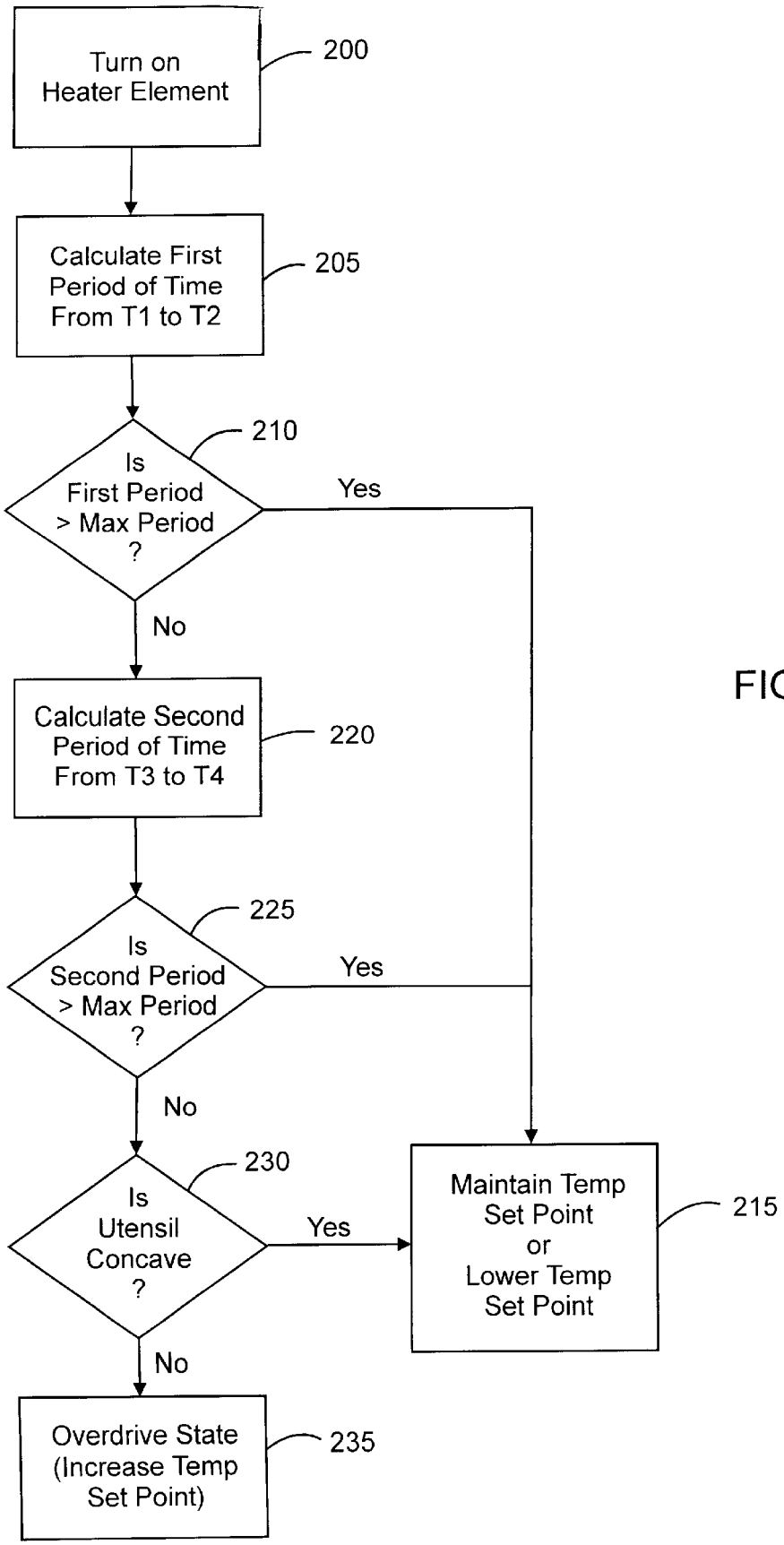
FIG. 15 is a flowchart of the operation of a controller for a heating unit in one embodiment of the present invention to determine whether to enter into an overdrive state.

FIG. 15 shows one embodiment of operating the heating unit 10 and determining whether to go into an overdrive state. The controller 110 first turns on the heating element 30 and directs the heating unit 10 to a first set point. [200] The controller 110 then monitors the sensed temperature $S_t$ received from the temperature sensor 70 and calculates a first period of time that it takes the sensed temperature $S_t$ to travel from a first temperature $T_1$ to a second temperature $T_2$. [205] The controller 110 will then determine whether the first period of time has exceeded a maximum period of time. [210] This determination may indicate whether the utensil if off-center, very small or convex. If the maximum period of time has been exceeded, the controller 110 will maintain the first set point. [215] Alternatively, the controller 110 may lower the first set point to a lower set point. If the maximum period of time has not been exceeded, the controller 110 will then calculate a second period of time that it takes the sensed temperature $S_t$ to travel from a third temperature $T_3$ to a fourth temperature $T_4$. [220] The controller 110 determines whether the second period of time has exceeded a maximum period of time. [225] This determination may indicate whether the utensil if off-center, very small or convex. If the maximum period of time has been exceeded, the controller 110 will maintain the first set point. [215] Alternatively, the controller 110 may lower the first set point to a lower set point. If the maximum period of time has not been exceeded, the controller 110 will determine whether a concave utensil exists by comparing the first period of time to the second period of time. [230] If a concave utensil exists, the controller 110 may maintain the temperature at the first set point or, alternatively, lower the first set point to a lower set point. [215] If a concave utensil does not exist, the controller 110 may enter an overdrive state where it increases the first set point to a second set point for a select period of time. [235]

A person of ordinary skill in the art, having the benefit of this disclosure, would realize that other methods of determining the temperature profile may be used. For example, the temperature increase between two fixed periods of time may be used and compared in a manner similar to the method described above. This may include: measuring a first increase in the sensed temperature during a first period of time; measuring a second increase in the sensed temperature during a second period of time; comparing the first increase in the sensed temperature to the second increase in sensed temperature; determining whether to increase the first temperature setting to a second temperature setting in the heating unit; and increasing the first temperature setting to the second temperature setting if it is determined that the first temperature setting may be increased from the first temperature setting to the second temperature setting. Moreover, different periods of time may be measured for select temperatures and the divided rates compared.

In one embodiment, the described methods or schemes are performed by the controller 110. The controller 110 implements the control schemes of the present invention through embedded software.

What has been described is a radiant heating unit for use in cooktops to more efficiently and quickly cook food placed on the unit. In one embodiment, the radiant heating unit is modular. The thermal switch normally used in such units is eliminated and replaced by a temperature sensor that supplies a temperature indication of the heating unit temperature to a controller. The controller supplies power to the heating element. A new temperature sensor design for use with the heating unit enables the heating unit to reach cooking temperatures faster than with conventional elements. By sensing the differences between the reflected radiant energy, the heater unit may determine whether it is possible to increase to a higher temperature set point. Moreover, in the modular embodiment, the heating unit is self-contained and may be sold as new equipment or as replacement equipment. Multiple heating units are retained in holes of the cooktop, and each unit includes terminal blocks to permit easy removal and installation. The heating unit has a simple construction so the cooktop requires fewer parts than cooktops using conventional heating units. This not only reduces costs, but also maintenance time.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A support for a temperature sensor in a heating unit, the temperature sensor having a sensing element and lead wires, the heating unit having a heating element that radiates direct radiant energy, the support comprising:

an insulating post having an upper head portion and a lower base portion, the upper head portion having a recess to house at least a portion of the sensing element of the temperature sensor, the recess shielding at least a portion of the sensing element of the temperature sensor from the direct radiant energy of the heating element, the base portion having at least one hole to receive the lead wires of the temperature sensor.

2. The support of claim 1, wherein the head portion has slots to receive the lead wires of the temperature sensor, the support further has at least one insulating cover to shield the wires from the direct radiant energy of the heating element.

3. The support of claim 1, wherein the insulating post is made of ceramic.

4. The support of claim 1, wherein the temperature sensor is a platinum RTD.

5. The support of claim 1, wherein the heating unit is modular.

6. A temperature sensor assembly for a heating unit, the heating unit having a heating element that radiates direct radiant energy, the temperature sensor assembly comprising:

a temperature sensor having a temperature sensing element and lead wires; and a support post having an upper head portion and a lower base portion, the upper head portion having a recess to house at least a portion of the sensing element of the temperature sensor, the recess shielding at least a portion of the temperature sensor from the direct radiant energy of the heating element, the base portion having a means for receiving the lead wires of the temperature sensor.

7. The temperature sensor assembly of claim 6, wherein the insulating post is made of ceramic.

8. The temperature sensor assembly of claim 6, wherein the temperature sensor is a platinum RTD.

9. The temperature sensor assembly of claim 6, wherein the heating unit is modular.

10. The temperature sensor assembly of claim 6 further including a terminal block electrically connected to the lead wires of the temperature sensor.

11. The temperature sensor assembly of claim 6 further including a shield to protect the temperature sensor from the direct radiant energy from the heating element.

12. A temperature sensor assembly for a heating unit, the heating unit having a heating element that radiates direct radiant energy, the temperature sensor assembly comprising:

a temperature sensor having a temperature sensing element and lead wires; and a support post having an upper head portion and a lower base portion, the upper head portion having a recess to house at least a portion of the sensing element of the temperature sensor, the recess shielding at least a portion of the temperature sensor from the direct radiant energy of the heating element, the base portion having a means for receiving the lead wires of the temperature sensor, the head portion has slots to receive the lead wires of the temperature sensor, the support further has at least one insulating cover to shield the wires from the direct radiant energy of the heating element.

13. A heating unit adapted to be installed in a cooktop wherein operation of the heating unit is controlled by a controller, the heating unit comprising:

a cooking plate;

a support pan being disposed beneath the cooking plate;

an insulation layer having an insulation base and an insulation sidewall ring, the insulation base supported inside the pan;

a heating element supported on the insulation base, the heating element in a spaced apart relationship to the cooking plate, the heating element capable of radiating direct radiant energy;

a temperature sensor for sensing a temperature inside the heating unit, the temperature sensor having a sensing element and lead wires;

support post having an upper head portion and a lower base portion, the upper head portion having a recess to house at least a portion of the sensing element of the temperature sensor, the recess shielding at least a portion of the sensing element from the direct radiant energy of the heating element; and a shielding member to shield the temperature sensor from the direct radiant energy from the heating element.

14. The heating unit of claim 11, wherein the heating unit is modular with relation to the cooktop.

15. The heating unit of claim 13, wherein the cooking plate is made of glass-ceramic.

16. The heating unit of claim 13, wherein the heating element is a ribbon type heating element.

17. The heating unit of claim 13, wherein the insulation base of the insulation layer has a hole to receive at least a portion of the support post.

18. The heating unit of claim 17, wherein the hole and the portion of the support post to be received in the hole are shaped to prevent movement of the support post in relation to the insulation base.

19. The heating unit of claim 13, wherein the temperature sensor is a platinum RTD.

20. The heating unit of claim 13, wherein the support post is made of ceramic.

21. The heating unit of claim 13, wherein the head portion of the support post has slots to receive the lead wires of the temperature sensor, the support post further has at least one insulating cover to shield the wires from the direct radiant energy of the heating element.

22. A heating unit adapted to be installed in a cooktop wherein operation of the heating unit is controlled by a controller, the heating unit comprising:

a cooking plate;

a support pan being disposed beneath the cooking plate;

an insulation layer having an insulation base and an insulation sidewall ring, the insulation base supported inside the pan;

a heating element supported on the insulation base, the heating element in a spaced apart relationship to the cooking plate, the heating element capable of radiating direct radiant energy;

a temperature sensor for sensing a temperature inside the heating unit, the temperature sensor having a sensing element and lead wires;

a support post having an upper head portion and a lower base portion, the upper head portion having a recess to house at least a portion of the sensing element of the temperature sensor, the recess shielding at least a portion of the sensing element from the direct radiant energy of the heating element, the head portion of the support post has slots to receive the lead wires of the temperature sensor, the support post further has at least one insulating cover to shield the wires from the direct radiant energy of the heating element.

23. A heating unit adapted to be installed in a cooktop, the heating unit comprising:

a cooking plate;

a support pan being disposed beneath the cooking plate;

an insulation layer having an insulation base and an insulation sidewall ring, the insulation base supported inside the pan;

a heating element supported on the insulation base, the heating element in a spaced apart relationship to the cooking plate, the heating element capable of radiating direct radiant energy;

a temperature sensor for sensing a temperature inside the heating unit, the temperature sensor having a sensing element and lead wires;

a support post having an upper head portion and a lower base portion, the upper head portion having a recess to house at least a portion of the sensing element of the temperature sensor, recess shielding at least a portion of the sensing element from the direct radiant energy of the heating element, the insulation base of the insulation layer has a hole to receive at least a portion of the support post, the hole and the portion of the support post to be received in the hole are key-type shaped such that when the portion of the support post is mated with the hole the support post cannot move in relation to the insulation base.

24. A heating unit adapted to be installed in a cooktop wherein operation of the heating unit is controlled by a controller, the heating unit comprising:

a cooking plate;

a heating element capable of radiating direct radiant energy;

a temperature sensor for sensing a temperature inside the heating unit, the temperature sensor having a sensing element and lead wires;

a support post having an upper head portion and a lower base portion, the upper head portion having a recess to house at least a portion of the sensing element of the temperature sensor, the recess shielding at least a portion of the sensing element from the direct radiant energy of the heating element; and a terminal block electrically connected to the lead wires of the temperature sensor.

25. The heating unit of claim 24 wherein said terminal block is capable of electrically connecting with said controller to carry a sensed temperature signal.

26. The heating unit of claim 24 wherein each of said lead wires include a connector that is capable of being inserted into said terminal block.

27. The heating unit of claim 24 further including a shield to protect the temperature sensor from the direct radiant energy from the heating element.

* * * * *

UNITED STATES PATENT AND TRADEMARK OFFICE

CERTIFICATE OF CORRECTION

PATENT NO. : 6,417,496 B1
DATED : July 9, 2002
INVENTOR(S) : Jeffrey A. Bates et al.

It is certified that error appears in the above-identified patent and that said Letters Patent is hereby corrected as shown below:

Column 14,
Line 53, before the word "recess" add the word -- the --

Signed and Sealed this

Fourth Day of February, 2003

JAMES E. ROGAN
*Director of the United States Patent and Trademark Office*